US010106395B2

(12) United States Patent
Paskert

(10) Patent No.: US 10,106,395 B2
(45) Date of Patent: Oct. 23, 2018

(54) BEVERAGE DISPENSING SYSTEM

(71) Applicant: Carl J Paskert, Parma, OH (US)

(72) Inventor: Carl J Paskert, Parma, OH (US)

( * ) Notice: Subject to any disclaimer, the term of this patent is extended or adjusted under 35 U.S.C. 154(b) by 211 days.

(21) Appl. No.: 15/373,304

(22) Filed: Dec. 8, 2016

(65) Prior Publication Data

US 2017/0260038 A1 Sep. 14, 2017

Related U.S. Application Data

(60) Provisional application No. 62/306,560, filed on Mar. 10, 2016.

(51) Int. Cl.
*B67D 3/00* (2006.01)

(52) U.S. Cl.
CPC ..... *B67D 3/0032* (2013.01); *B67D 3/0083* (2013.01); *B67D 3/0096* (2013.01)

(58) Field of Classification Search
CPC ... B67D 3/0032; B67D 3/0083; B67D 3/0096
See application file for complete search history.

(56) References Cited

U.S. PATENT DOCUMENTS

| | | | | |
|---|---|---|---|---|
| 4,646,944 | A * | 3/1987 | Sanderson | B67D 3/00 222/108 |
| 6,527,145 | B1 * | 3/2003 | Bennett, Jr. | B67D 3/0035 222/185.1 |
| 6,892,903 | B1 * | 5/2005 | Bartolotta | B67D 3/0029 222/185.1 |
| 9,016,525 | B2 * | 4/2015 | Henderson | B67D 3/0035 222/185.1 |
| 2009/0218370 | A1 * | 9/2009 | Michels | B67B 7/28 222/185.1 |

* cited by examiner

*Primary Examiner* — Ryan A Reis

(57) ABSTRACT

A beverage dispensing system for use with a beverage container includes a base with lower, side and upper external surfaces, a vertically-inclined bore within the base extending a first pre-defined distance into the base from the upper external surface and defines an upper opening in the base, a horizontally-inclined bore within the base extending into the base from the side external surface and defining a side opening in the base connected to the vertically-inclined bore forming a continuous internal channel, an outlet valve secured at the side opening in the base, an adapter assembly accessible from the upper opening in the base including a rigid cap, elastic sleeve and vent line. A flexible tubing extending through the continuous internal channel connects the outlet valve to the adapter assembly.

8 Claims, 8 Drawing Sheets

BEVERAGE DISPENSING SYSTEM

CROSS-REFERENCE TO RELATED APPLICATIONS

This application relates to and claims the benefit of prior U.S. Provisional Application No. 62/306,560 filed on Mar. 10, 2016, incorporated by reference herein.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention relates to beverage dispenser systems suitable for dispensing beverages from a beverage container and more particularly to beverage dispenser systems that provide airtight beverage storage and do not require inversion prior to connection with the beverage container.

BACKGROUND OF THE INVENTION

Many beverage dispensers for bottled liquors, water, wine and other beverages are gravity fed such that an inverted beverage container is connected to the inlet located on the top surface of the dispenser. Such beverage dispensers also possess a pressure equalizing valve to allow air into the beverage container so as to ensure continual flow of the beverage contained therein. A valve, such as a faucet or spigot is provided on the beverage dispenser to provide controlled release of the beverage as desired by the user.

In U.S. Pat. No. 6,892,903 to Bartolotta, a beverage dispenser is described with a base having a screw threaded inlet on the top surface for connection of a beverage container with a threaded outlet valve. The beverage dispenser necessarily has to be inverted to allow connection with the beverage container, otherwise uncontrolled release of the beverage would occur should an inverted container be connected with the upright dispenser. Furthermore this beverage dispenser can only be used with beverage containers having a matching screw thread diameter on the container opening, thus excluding its compatibility with other container opening sizes and types.

In another beverage dispenser described in U.S. Pat. No. 9,016,525 to Henderson, a simple device is provided with a base containing an internal L-shaped bore hole extending from the upper surface to the side surface. The side surface hole is capped by an outlet valve, yet the hole on the upper surface is open and requires the whole dispenser to be inverted to engage the opening of a beverage container. Furthermore the beverage is in open contact with the internal sides of the L-shaped bore during use and as the hole on the upper surface is open to the environment there is potential for contamination of the beverage by bacteria, insects, viruses and other agents. The diameter of the hole on the upper surface is fixed during manufacture, thus this limits the compatibility of the dispenser to beverage container openings with matching diameters.

Accordingly there is a need for a beverage dispensing system that overcomes the above shortcomings and provides a hygienic system compatible with a wide range of beverage container openings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the present invention to provide a beverage dispenser system that securely supports inverted beverage containers of varying shapes and sizes placed on the upper external surface of the base unit of the system.

It is an object of the present invention to provide a beverage dispenser system having airtight connection with beverage containers of varying opening diameters, shapes and sizes.

It is another object of the present invention to provide a beverage dispenser system that can be connected to the opening of an upright beverage container without need to invert the beverage dispensing system.

These and other objects are achieved by providing a beverage dispenser system, having a base with a continuous internal channel hosting a flexible internal tubing attached at a first end by a first airtight connector to an outlet valve, for dispensing of a beverage, and at a second end by a second airtight connector to an adapter assembly for connection with a beverage container. In one embodiment of the present invention a beverage dispensing system is provided having a base with lower, side and upper external surfaces. The base having a vertically-inclined bore extending a first pre-defined distance partially into the base from the upper external surface and defining an upper opening in the base. The base having a horizontally-inclined bore within the base partially extending a second pre-defined distance into the base from the side external surface and defining a side opening in the base in connection with the vertically-inclined bore, an outlet valve being secured at the side opening in the base.

The adapter assembly, having a rigid cap an elastic sleeve, a one-way valve and a vent line, is accessible to the user from the upper opening in the base.

The rigid cap having first and second openings to receive the one-way valve with vent line and the flexible tubing respectively, and the elastic sleeve have a first end in frictional airtight contact with the rigid cap and a second end defining a flexible ring-shaped opening to receive the neck portion of a beverage container and create an airtight seal around said neck portion.

The flexible tubing having first and second ends, the flexible tubing extending within the horizontally-inclined and vertical-inclined bores such that the first end of the flexible tubing is airtight connected to the outlet valve and the second end of the flexible tubing is airtight connected to an opening in the rigid end of the adapter assembly.

In one embodiment of the present invention the outlet valve is a faucet, a spigot or a tap.

In one embodiment of the present invention the rigid cap of the adapter assembly is constructed from a hard plastic material with two openings for insertion of the flexible tubing and the one-way valve respectively, wherein the one-way valve is connected to a vent line extending within the elastic sleeve and protruding from the outerwards for insertion into the beverage container.

In one embodiment of the present invention the one-way valve present in the rigid cap is a check valve.

In one embodiment the flexible tubing has a first end of which is a threaded airtight connector to receive the outlet valve and has a second end which is a push fit airtight connector to receive an opening present in the rigid end of the tubular sleeve. In other embodiments, the flexible has a first end with a push fit connector and a second end with a threaded or push fit connector, alternatively both connectors are threaded.

In one embodiment of the present invention the base is of cylindrical shape with lower and upper horizontal surfaces connected by a curved side surface.

In one embodiment of the present invention the base is constructed from a natural tree log, or portion thereof. In other embodiments the base is constructed from sealant coated wood, a tree trunk, a tree trunk section or a plastic imitation tree trunk section. Suitable sealants include acrylic sealants, varnishes, oil based, shellac and lacquers known in the art. In other embodiments the base is further treated with one or more of anti-fungal, insecticide agents and heat treated.

In another embodiment of the present invention the beverage dispenser system includes a beverage container, the opening of the beverage container engaged with the elastic sleeve to form a beverage liquid tight and airtight connection.

In a further embodiment the beverage container is one of a carbonated, liquor, wine or non-carbonated beverage container.

Various objects, features, aspects and advantages of the present invention will become more apparent from the following detailed description of the embodiments of the invention, along with the accompanying drawings in which like numerals represent like components.

BRIEF DESCRIPTION OF THE DRAWINGS

The accompanying drawing(s), which are incorporated in and constitute a part of this specification, illustrate several aspects described below.

DETAILED DESCRIPTION

Figure 1:
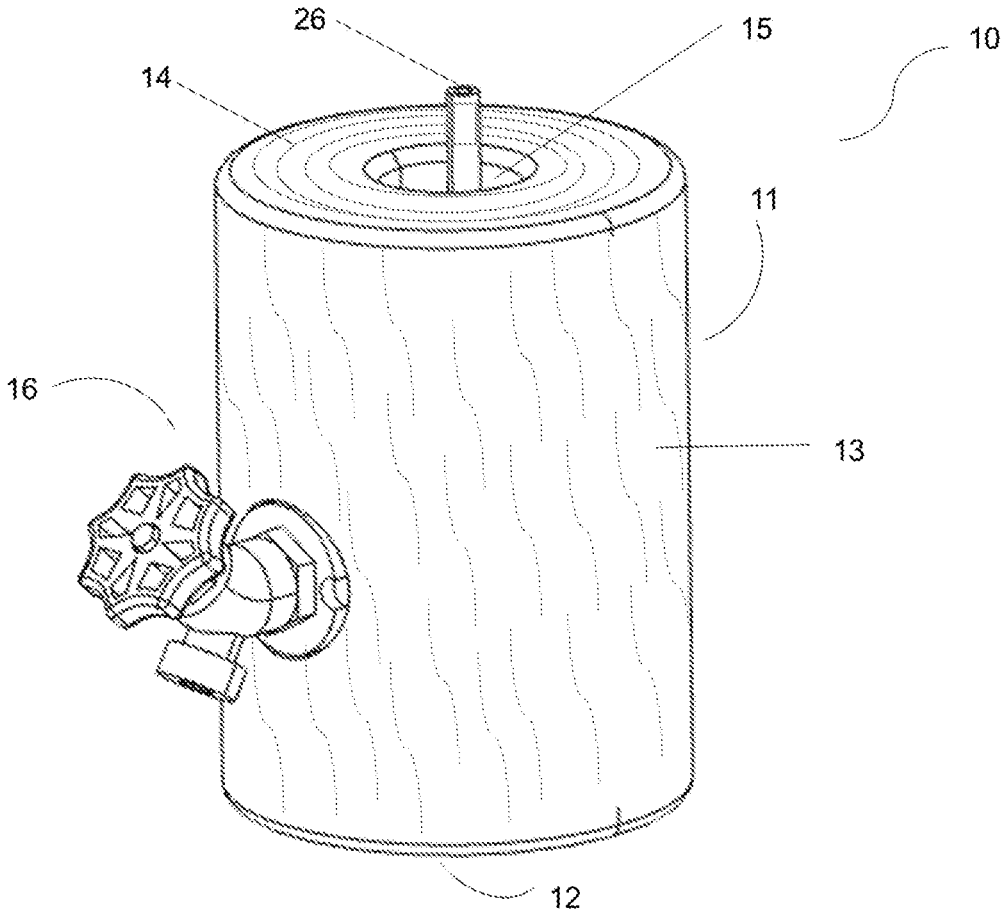
FIG. 1 illustrates a perspective view of one embodiment of the beverage dispenser system of the present invention made of a tree trunk section showing lower, side and upper external surfaces, an outlet valve, an adapter assembly protruding from vertically-inclined bore in the upper external surface.

The beverage dispenser system of the present invention is described with reference to FIGS. 1-8. FIG. 1 illustrates a perspective view of one embodiment of the beverage dispenser system 10 of the present invention having a base 11 with a flat lower surface 12 suitable for resting the base 11 on a horizontal surface, a side face 13 with an outlet valve 16, a flat upper external surface 14 with a vertically inclined bore 15 extending into the base 11 and a vent line 26 extending out of the vertically inclined bore 15.

In one embodiment the base is constructed from a natural tree trunk section, side face 13 is patterned by the natural texture of tree bark. In another embodiment the base is constructed from a plastic imitation tree trunk section, side face 13 is patterned to reproduce the texture of tree bark.

Figure 2:
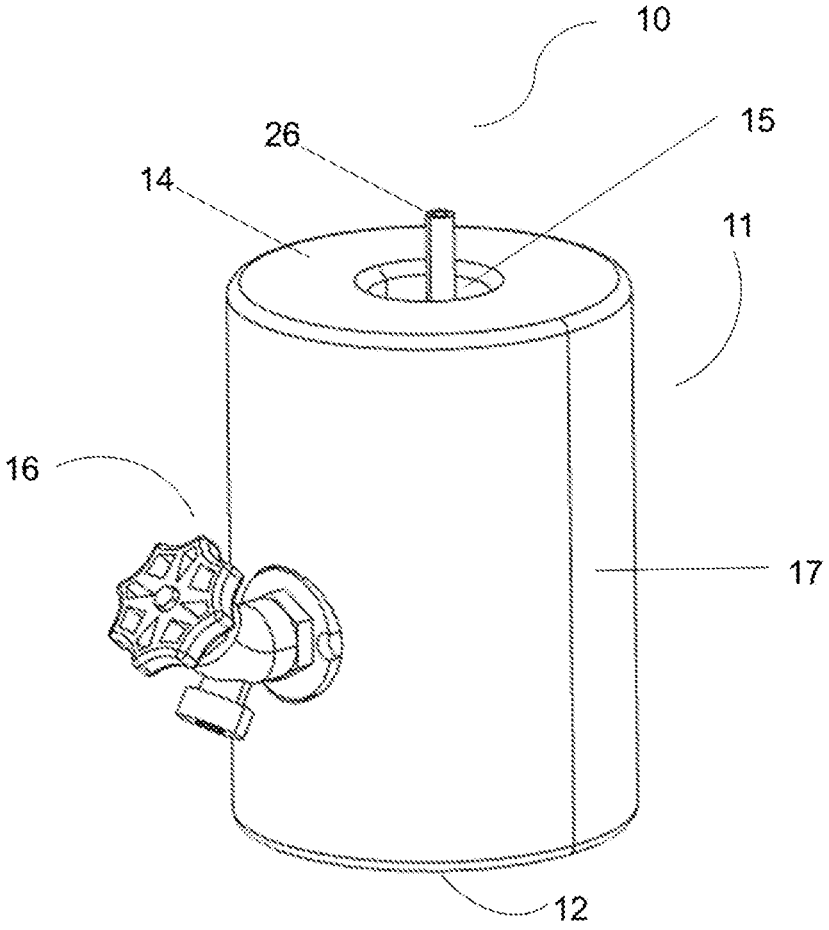
FIG. 2 illustrates a perspective view of another embodiment of the beverage dispenser system of the present invention showing lower, side and upper external surfaces, an outlet valve, an adapter assembly protruding from vertically-inclined bore in the upper external surface.

FIG. 2 illustrates a perspective view of another embodiment of the beverage dispenser system 10 of the present invention having a base 11 with a flat lower surface 12 suitable for resting the base 11 on a horizontal surface, a side face 17 with an outlet valve 16, a flat upper external surface 14 with a vertically inclined bore 15 extending into the base 11 and a vent line 26 extending out of the vertically inclined bore 15. The base is constructed from a plastic, metal, stone or wooden block. The side face 17 can be smooth, textured or adorned with designs, images or other artistic features.

In FIGS. 1 and 2 the outlet valve 16 is a faucet, it is contemplated that other outlet valves known in the art can be substituted to serve the same purpose of providing controlled release of the beverage.

Figure 3:
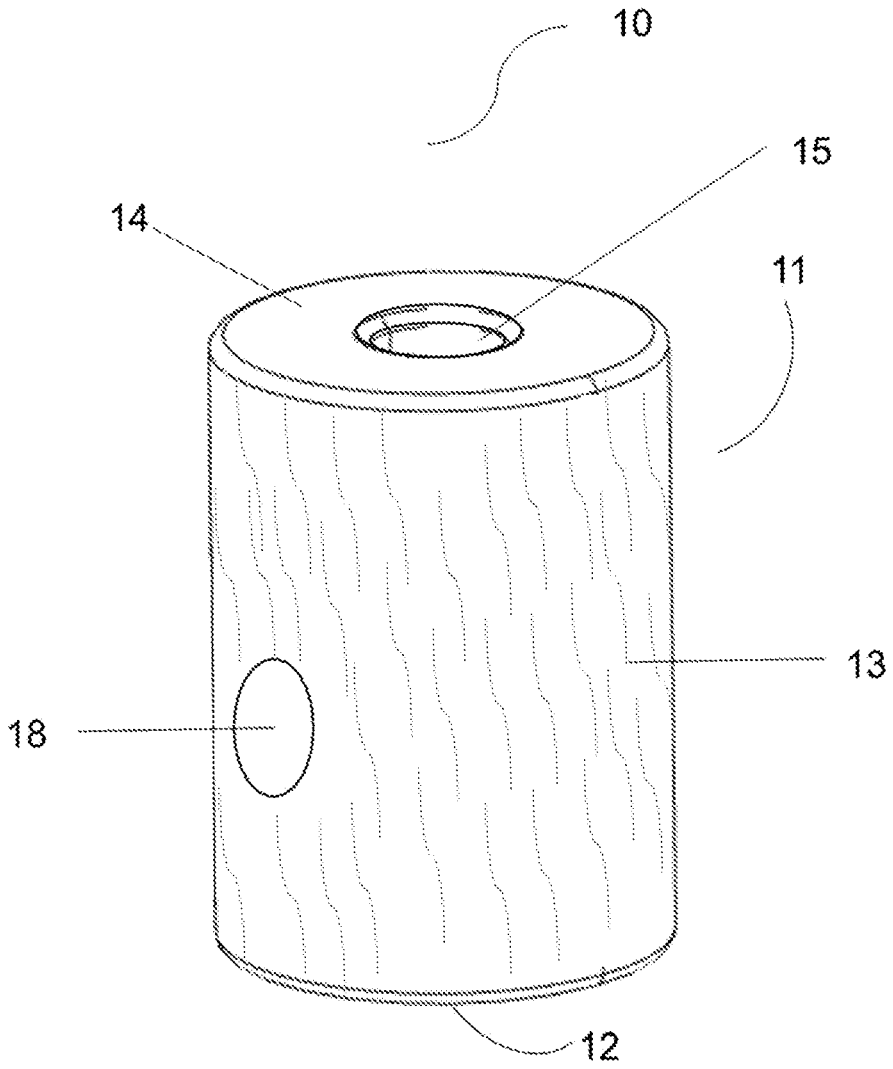
FIG. 3 illustrates a perspective view of one embodiment of the beverage dispenser system of the present invention showing lower, side and upper external surfaces, a vertically-inclined bore in the upper external surface and a horizontally-inclined bore in the side surface.

FIG. 3 illustrates one embodiment of the base 11 of the beverage dispenser system 10 of the present invention. The base 11 having a flat lower external surface 12 suitable for resting on a horizontal surface, a side face 13 with a horizontally inclined bore 18 extending into the base 11, a flat upper external surface 14, suitable for resting an inverted beverage container thereon, with a vertically inclined bore 15 extending into the base 11.

Figure 4:
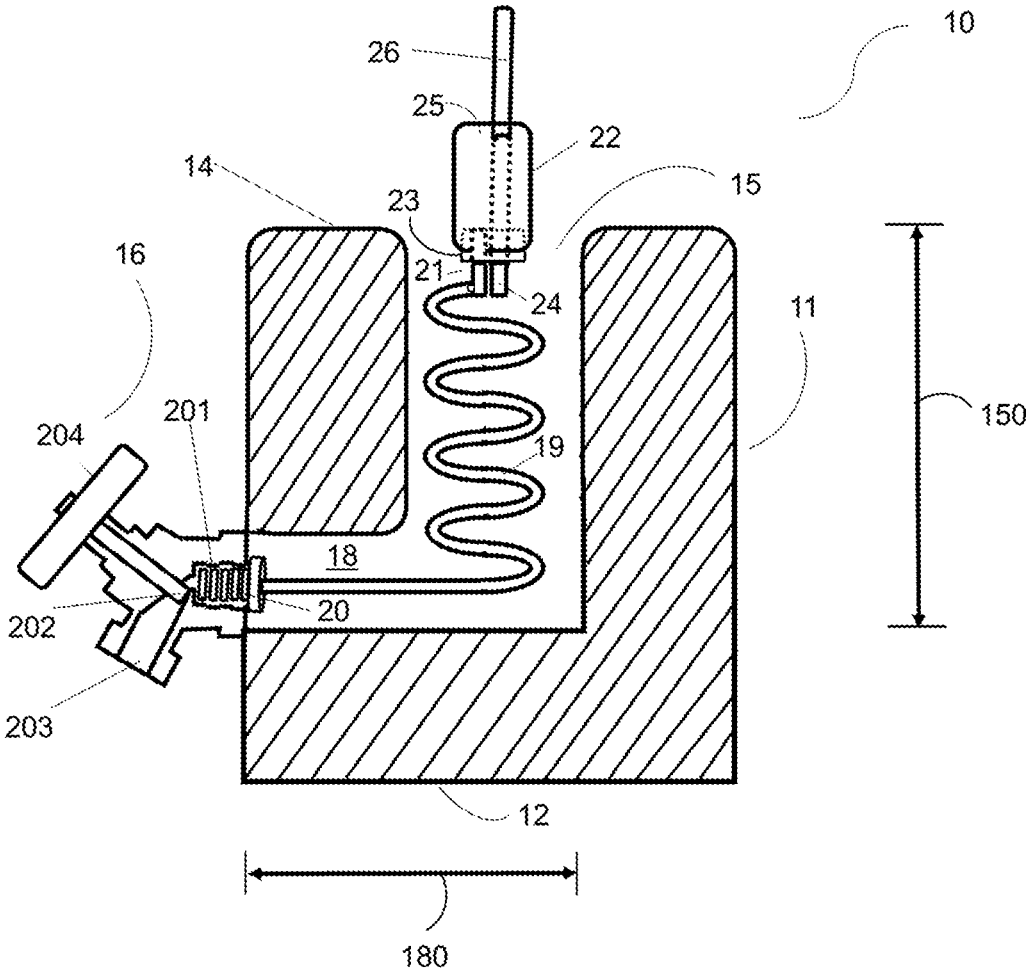
FIG. 4 illustrates a cross sectional view of beverage dispenser system of FIG. 1, 2 or 3 having an outlet valve, coiled flexible tubing and adapter assembly with vent line disposed within the continuous internal channel defined by the connecting horizontal and vertical bores.

With reference to FIG. 4 the horizontally inclined bore 18 and vertically inclined bore 15 form a continuous internal channel within the body of the base 11. The continuous channel of bores 15 and 18 houses a flexible tubing 19 constructed from PVC or other beverage compatible flexible plastic. The flexible tubing 19 is coiled, within the continuous internal channel defined by bores 15 and 18, to increase the length of tubing held within the base 11.

Figure 5:
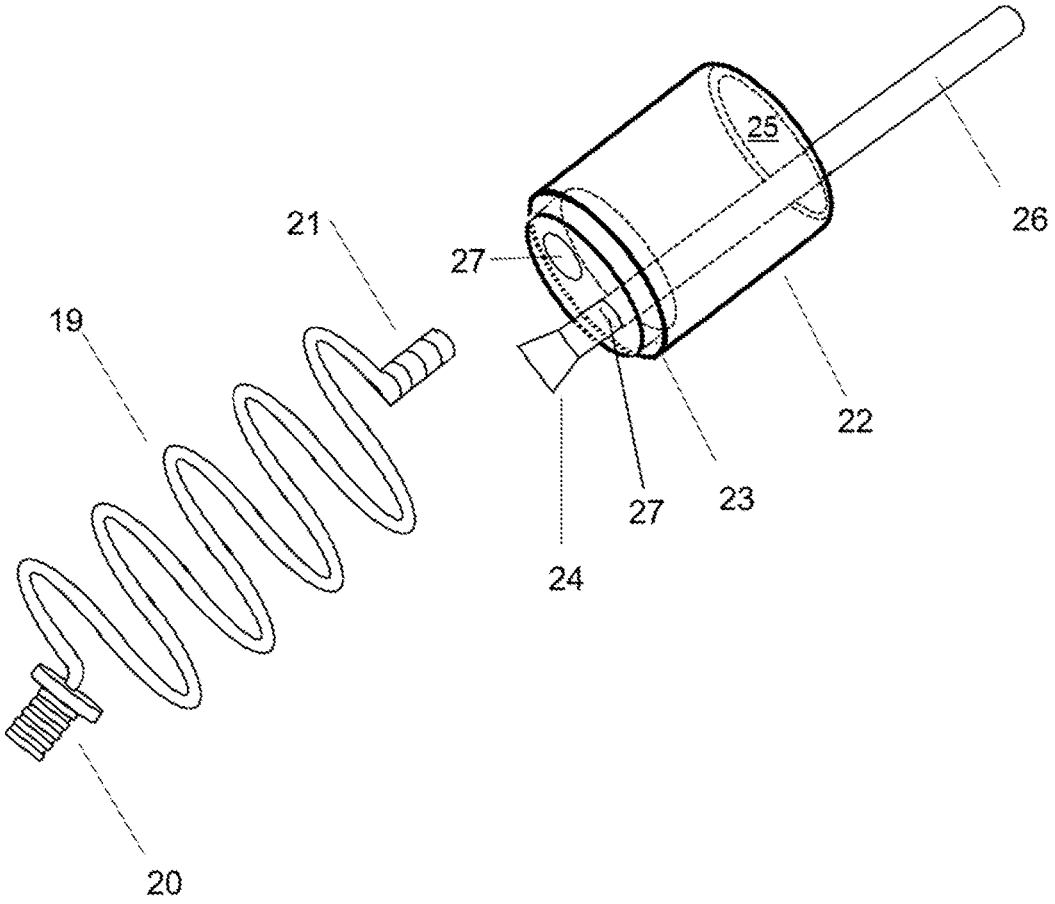
FIG. 5 illustrates an embodiment of the flexible tubing and the adapter assembly of the beverage dispenser system of the present invention having threaded airtight outlet valve connector, coiled flexible tubing and an airtight push fit connector suitable for engagement with the adapter assembly including cap, elastic sleeve, one-way valve and vent line.

With reference to FIGS. 4 and 5, in one embodiment of the beverage dispenser system 10 of the present invention has a flexible tubing 19 terminated at a first end with a male threaded connector 20 for airtight engagement with the outlet valve 16 and terminated at a second end by a barbed push fit elbow joint connector 21 for airtight engagement with the one of the openings 27 available at rigid cap 23 in frictional airtight contact with elastic sleeve 22.

In other embodiments it is contemplated that connectors 20 and 21 can each independently be in the form of screw thread, push fit or other airtight connectors known in the art.

With reference to FIGS. 4, 5, 7 and 8 illustrate one embodiment of adapter assembly having an elastic sleeve 22, a rigid cap 23 constructed from a hard plastic material, such as PVC, having two openings 27 to receive connector 21 of tubing 19 and one-way valve 24. In one embodiment the one-way valve 24 is a check valve, a suitable example is a KYNAR diaphragm check valve. In other embodiments the one-way valve 24 is any other valve known in the prior art that allows one way flow of air.

The one-way valve 24 is connected to vent line 26 that extends through the internal body of elastic sleeve 22 and outerwards from opening 25 and continues into the internal recess of the beverage container 30. Opening 25 of elastic sleeve 22 defines a ring shaped opening for receiving the neck or opening of a beverage container. Elastic sleeve 22 is constructed from a material such as latex or other watertight synthetic material capable of recovering their original shape after being stretched. The elasticity of sleeve 22 allows the formation of a beverage liquid tight and airtight seal between opening 25 and the neck of a wide variety of beverage containers irrespectively of shape or size.

Figure 6:
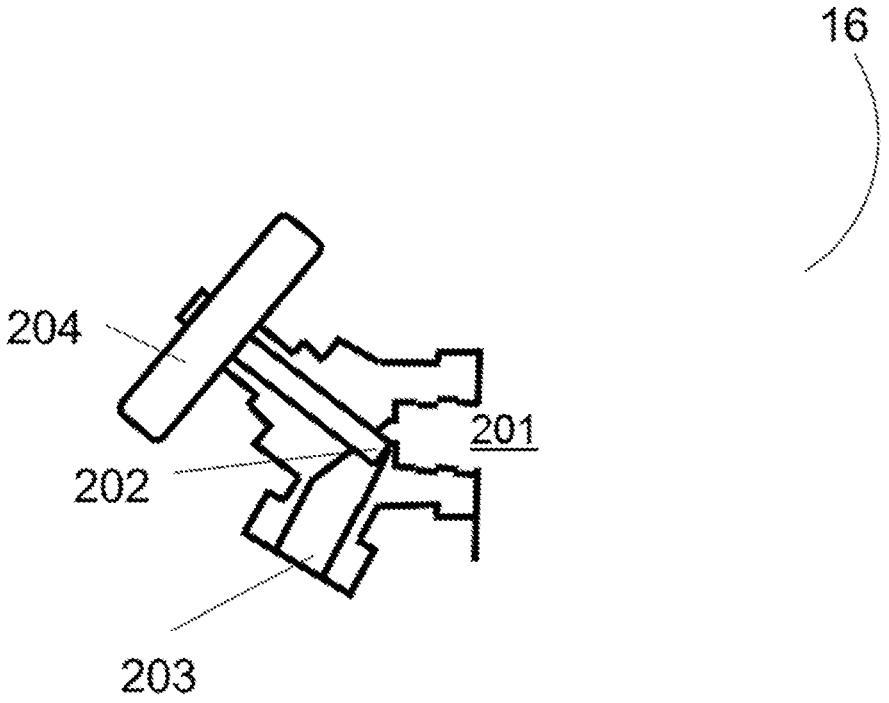
FIG. 6 illustrates an embodiment of the outlet valve of the beverage dispenser system of the present invention.

With reference to FIG. 6, illustrates one embodiment of the outlet valve 16 of the present invention, possessing a threaded female connector 201, to receive threaded male connector 20 of the elastic tubing 19, and a valve 202 for controlled release of the beverage via channel 203. Valve 202 being reversibly opened and closed by rotation of handle 204. The outlet valve 16 is attached to the side external face 13 by means of adhesive, nails or screws.

In one embodiment the base 11 having a flat lower external surface 12, for placement on a horizontal surface such as a table or sideboard, and the flat upper external surface 14, a side face 13 with a horizontally inclined bore 18 extending into the base 11, a flat upper external surface 14, suitable for resting an inverted beverage container thereon, with a vertically inclined bore 15 extending into the base 11 is constructed from a section of a tree trunk. Thus trees are harvested and sawn into trunk sections using a saw or chainsaw, the trunk sections have a preferred height of 8-11 inches. Trunk sections are subsequently pressured washed with water, treated with one or more agents selected from an anti-fungal, insecticide and heat treatment. The post-treatment trunks sections are left open to the atmosphere to dry.

With reference to FIG. 4, the horizontally inclined bore 18 and vertically inclined bore 15 are formed by use of a core drill boring a first pre-defined distance 150 into the upper external face 14 and a second pre-defined distance 180 into side external face 13 to create the base 11. The first and second pre-defined distances can be chosen by the user or manufacturer and depend on the preferred position of the outlet valve 16, diameter and height of the base 11. Bore diameters can be varied according to the size of the trunk section and size of the outlet valve 16 and beverage container intended for use. Boring is completed on creation of the continuous internal channel formed by joining both bores. Optionally the openings to one or both bores are beveled and each bore is smoothed by use of a cylinder sander or equivalent abrasive device known in the art. Lower external face 12 and upper external face 14 can be smoothed by use of a sander to avoid contact of the user with rough sections of the tree trunk.

With the base 11 in hand the beverage dispensing system of the present invention can be completed by inserting flexible tubing 19 in to the continuous internal channel, engaging male threaded connector 20 into female connector 201 of outlet valve 16, affixing outlet valve 16 securely to external side face 13 or 17.

With reference to FIG. 5, the adapter assembly is constructed by selecting a suitable length of latex tubing, or other watertight synthetic material, for use as the elastic sleeve 22, one end of the elastic sleeve is pushed over the rigid cap 23 to form a watertight seal. A check valve 24, vent line 26 and the push fit connector 21, of flexible tubing 19, are inserted into openings 27 of the rigid cap.

With reference to FIGS. 1-8 the horizontally inclined bore 18 and vertically inclined bore 15 are shown to form an internal L-shaped continuous internal channel within base 11. It is contemplated that the bores can be angled away from the horizontal plane or vertical plane without the need to form an exact L-shaped continuous channel. In other embodiments of the beverage dispenser 10 of the present invention a curved or straight continuous internal channel extending from the upper external face 14 to the side external face 13 is used.

In one embodiment the base 11 lower external face 12 and upper external face 14, and tree bark present on the side face 13 are treated with an acrylic primer or sealant.

The use of the beverage dispenser system 10 of the present invention is described with reference to FIGS. 1-8.

Figure 7:
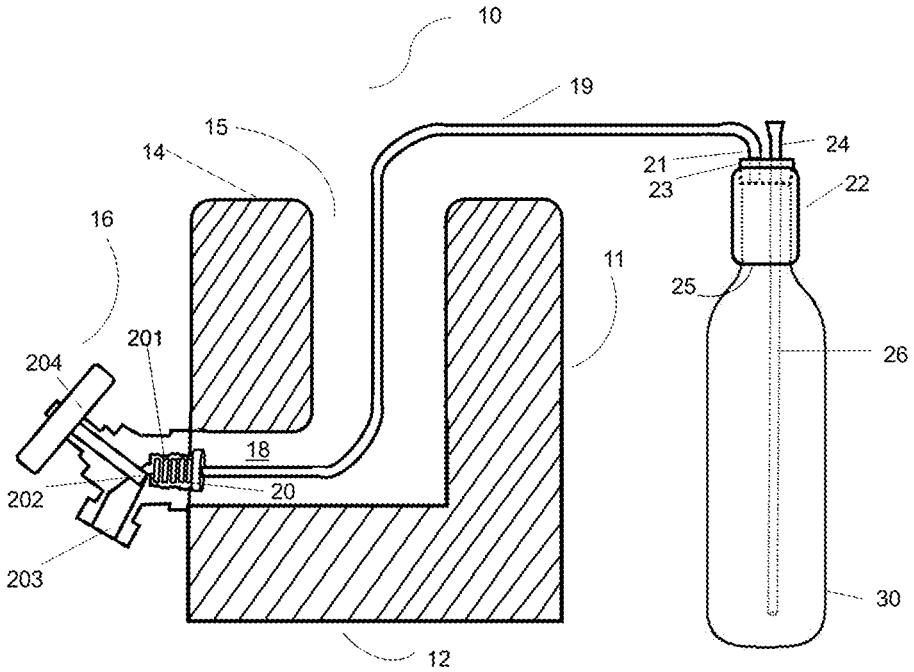
FIG. 7 illustrates a cross sectional view of beverage dispenser system of FIG. 1, 2 or 3 having an outlet valve, the extended flexible tubing partly disposed within the continuous internal channel defined by the connecting horizontal and vertical bores, and adapter assembly with vent line engaged with an upright beverage container.

With reference FIGS. 1 and 4, 7 and 8, in the resting configuration as shown in FIGS. 1 and 4 the flexible tubing 19 is coiled within the continuous internal channel defined by horizontally inclined bore 18 and vertically inclined bore 15. Vent line 26 and elastic sleeve 22 protrude from the opening of vertically inclined bore 15 in upper external surface 14 and are accessible to the user allowing the flexible tubing 19 to be extended, as illustrated in FIG. 7, until the opening 25 of the elastic sleeve 22 reaches and is engaged with the opening of an upright beverage container 30 providing a beverage liquid tight and airtight seal, and with the vent line 26 inserted into the beverage container 30.

Figure 8:
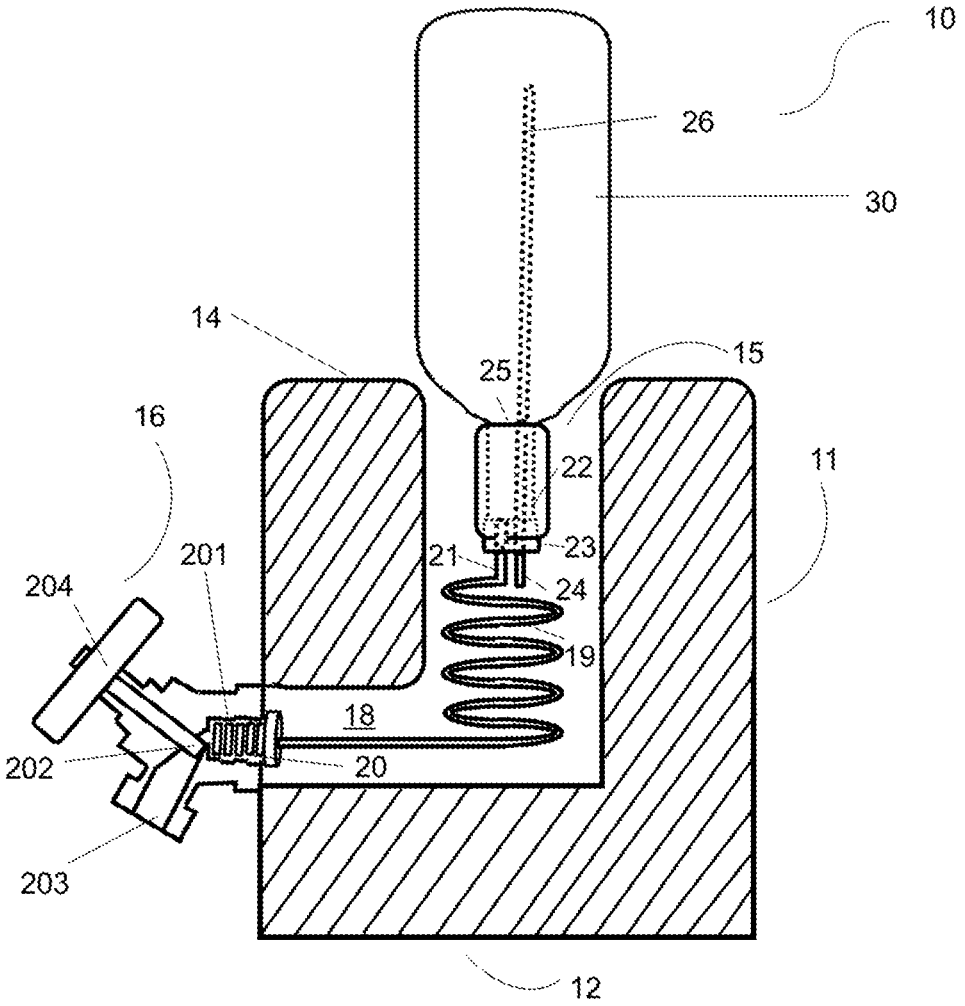
FIG. 8 illustrates a cross sectional view of beverage dispenser system of FIG. 1, 2 or 3 having an outlet valve, coiled flexible tubing and adapter assembly with vent line disposed within the continuous internal channel defined by the connecting horizontal and vertical bores, and an inverted beverage container engaged with the elastic sleeve and positioned to be supported by the upper external surface of the base.

With reference to FIG. 8, the beverage container 30 is inverted and placed on to the upper external surface 14. The flexible tubing 19 reverts back to a coiled configuration. FIG. 10 illustrates the position of the beverage container 30 in the beverage dispenser system 10 prior to dispensing of the beverage.

To dispenser the beverage held within the beverage container 30, the user rotates handle 204 of outlet valve 16 to open valve 202, as a result beverage flows from the container 30 through connector 21, then onwards through flexible tubing 19, connector 20 and out of channel 203. As the beverage flows out of the container 30, air enters into the one-way valve 24 then through vent line 26 into beverage container 30 to avoid formation of a vacuum therein and thus maintaining flow of the beverage.

The airtight beverage dispenser system described herein prevents access by environmental agents detrimental to the quality and safety of the beverage stored therein such as bacteria, insects, viruses and other agents.

It should be understood according to the preceding description of the present invention that the same is susceptible to changes, modifications and adaptations, and that the said changes, modifications and adaptations fall within scope of the appended claims.

What is claimed:

1. A beverage dispensing system for use with a beverage container, comprising:

a base with lower, side and upper external surfaces;

a vertically-inclined bore within the base extending a first pre-defined distance into the base from the upper external surface and defining an upper opening in the base;

a horizontally-inclined bore within the base extending a second pre-defined distance into the base from the side external surface and defining a side opening in the base in connection with the vertically-inclined bore;

an outlet valve secured at the side opening in the base;

an adapter assembly, accessible from the upper opening in the base, having an elastic sleeve with opposing first and second ends, a rigid cap having a one-way valve wherein the first end of the elastic sleeve is in airtight contact with the rigid cap, the second end of the elastic sleeve defining a flexible opening to receive a neck portion of a beverage container; and a flexible tubing with first and second ends, extending within the horizontally-inclined and vertical-inclined bores;

wherein, the first end of the flexible tubing is connected to the outlet valve and the second end of the flexible tubing is connected to the rigid cap.

2. The beverage dispensing system in accordance with claim 1, wherein the rigid cap comprises at least two openings, a first opening to receive the flexible tubing and a second opening to receive the one-way valve with a vent line extending outwards from the second end of the elastic sleeve.

3. The beverage dispensing system in accordance with claim 2, wherein the one-way valve is a check valve.

4. The beverage dispensing system in accordance with any one of claims 1 or 2, wherein the first end of the flexible tubing has a threaded connector for attachment to the outlet valve or has a pressure fit adapter to receive the outlet valve.

5. The beverage dispensing system in accordance with any one of claims 1 or 2, wherein the second end of the flexible tubing is threaded or has a pressure fit adapter to receive the rigid cap.

6. The beverage dispensing system in accordance with claim 1, wherein the base is constructed from a sealant coated wood, tree trunk, or tree trunk section.

7. A beverage dispensing system, comprising:

a base with lower, side and upper external surfaces;

a vertically-inclined bore within the base extending a first pre-defined distance into the base from the upper external surface and defining an upper opening in the base;

a horizontally-inclined bore within the base extending into the base from the side external surface and defining a side opening in the base in connection with the vertically-inclined bore;

an outlet valve secured at the side opening in the base;

an adapter assembly, accessible from the upper opening in the base, having an elastic sleeve with opposing first and second ends, a rigid cap having a one-way valve wherein the first end of the elastic sleeve is in airtight contact with the rigid cap, the second end of the elastic sleeve defining a flexible opening to receive a neck portion of a beverage container; and a flexible tubing with first and second ends, extending within the horizontally-inclined and vertical-inclined bores, wherein the first end of the flexible tubing is connected to the outlet valve and the second end of the flexible tubing is connected to the rigid cap;

wherein the neck portion of the beverage container is engaged with the second end of the elastic sleeve forming a liquid tight seal.

8. The beverage dispenser system of claim 6, wherein the beverage is an alcoholic liquor.

* * * * *